US007562996B2

(12) United States Patent
Maglica

(10) Patent No.: US 7,562,996 B2
(45) **Date of Patent: *Jul. 21, 2009**

(54) FLASHLIGHT

(75) Inventor: Anthony Maglica, Anaheim, CA (US)

(73) Assignee: MAG Instrument, Inc., Ontario, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/685,713

(22) Filed: Mar. 13, 2007

(65) Prior Publication Data

US 2007/0153506 A1 Jul. 5, 2007

Related U.S. Application Data

(63) Continuation of application No. 11/335,946, filed on Jan. 20, 2006, now Pat. No. 7,188,968, which is a continuation of application No. 10/961,634, filed on Oct. 7, 2004, now Pat. No. 7,001,042, which is a continuation of application No. 10/409,912, filed on Apr. 8, 2003, now Pat. No. 6,802,624, which is a continuation of application No. 10/210,340, filed on Jul. 31, 2002, now Pat. No. 6,554,449, which is a continuation of application No. 09/797,523, filed on Feb. 28, 2001, now Pat. No. 6,428,182, which is a continuation of application No. 08/931,548, filed on Sep. 16, 1997, now Pat. No. 6,196,698, which is a continuation of application No. 08/483,381, filed on Jun. 7, 1995, now Pat. No. 5,749,645, which is a continuation of application No. 08/138,918, filed on Oct. 18, 1993, now abandoned, which is a continuation of application No. 07/832,857, filed on Feb. 7, 1992, now Pat. No. 5,260,858.

(51) Int. Cl.
*F21L 4/04* (2006.01)

(52) U.S. Cl. ..... 362/205; 362/158; 362/202; 362/204; 200/60

(58) Field of Classification Search ..... 362/157, 362/158, 202, 204, 205; 200/60
See application file for complete search history.

(56) References Cited

U.S. PATENT DOCUMENTS

| | | | |
|---|---|---|---|
| 3,798,440 | A | 3/1974 | Brindley |
| 3,924,116 | A | 12/1975 | Brindley |
| 4,286,311 | A | 8/1981 | Maglica |
| 4,388,673 | A | 6/1983 | Maglica |
| 4,527,223 | A | 7/1985 | Maglica |
| 4,843,526 | A | 6/1989 | Price, III |
| 4,939,628 | A | 7/1990 | Wang |
| 4,940,860 | A | 7/1990 | Shiau |
| 4,951,183 | A | 8/1990 | Wang |
| 4,967,325 | A | 10/1990 | Shiau |
| 5,260,858 | A | 11/1993 | Maglica |
| 5,749,645 | A | 5/1998 | Maglica |
| 6,196,698 | B1 | 3/2001 | Maglica |
| 6,428,182 | B1 | 8/2002 | Maglica |
| 6,554,449 | B2 | 4/2003 | Maglica |

(Continued)

*Primary Examiner*—Stephen F Husar
(74) *Attorney, Agent, or Firm*—Jones Day

(57) ABSTRACT

A flashlight has a switch housing in between the battery compartment and reflector. The neck of the switch housing holds a lamp support at a central position within a reflector. An o-ring on the rear of the switch housing seals the battery compartment. The switch housing partially floats within the flashlight tube to allow for a slight adjustment of the lamp relative to the reflector to insure centering.

14 Claims, 3 Drawing Sheets

U.S. PATENT DOCUMENTS 6,802,624 B2 10/2004 Maglica 7,001,042 B2 2/2006 Maglica 7,188,968 B2 3/2007 Maglica

FLASHLIGHT

This application is a continuation of U.S. patent application Ser. No. 11/335,946, filed Jan. 20, 2006, now U.S. Pat. No. 7,188,968; which in turn is a continuation of U.S. patent application Ser. No. 10/961,634, filed Oct. 7, 2004, now U.S. Pat. No. 7,001,042; which in turn is a continuation of U.S. patent application Ser. No. 10/409,912, filed Apr. 8, 2003, now U.S. Pat. No. 6,802,624; which in turn is a continuation of U.S. patent application Ser. No. 10/210,340, filed Jul. 31, 2002, now U.S. Pat. No. 6,554,449; which in turn is a continuation of U.S. patent application Ser. No. 09/797,523, filed Feb. 28, 2001, now U.S. Pat. No. 6,428,182; which in turn is a continuation of U.S. patent application Ser. No. 08/931,548, filed Sep. 16, 1997, now U.S. Pat. No. 6,196,698; which in turn is a continuation of U.S. patent application Ser. No. 08/483,381, filed Jun. 7, 1995, now U.S. Pat. No. 5,749,645; which in turn is a continuation of U.S. patent application Ser. No. 08/138,918, filed Oct. 18, 1993, now abandoned; which in turn is a continuation of U.S. patent application Ser. No. 07/832,857, filed Feb. 7, 1992, now U.S. Pat. No. 5,260,858.

FIELD OF THE INVENTION

The present invention relates primarily to flashlights.

BACKGROUND OF THE INVENTION

Various flashlight designs are known in the art. Flashlights include one or more dry cell batteries and in certain designs the batteries are arranged in series in a battery compartment of a barrel or tube which acts as a handle for the flashlight. Electrical energy from the batteries is generally conducted to a lamp or bulb at the front end of the flashlight through a switch mechanism positioned between the batteries and the lamp.

In various flashlight designs, the lamp is supported within the flashlight by a holder or spacer within the barrel and extends into the flashlight reflector. For optimal performance, the lamp must be properly aligned with the reflector. However, due to manufacturing and assembly operations and tolerances, after manufacture of the flashlight is fully completed, the lamp may be permanently misaligned with the reflector, resulting in degraded performance.

In addition, since under certain conditions the batteries can leak, it is advantageous to seal the battery compartment of the flashlight. On the other hand, since batteries can also release gases, it is advantageous to vent the battery compartment without allowing ingress of moisture, contaminants, etc.

SUMMARY OF THE INVENTION

In a first aspect, the present invention is directed to a flashlight having an improved switch mechanism which contains a switch assembly with a forwardly extending neck supporting the flashlight lamp. The switch housing partially floats within the flashlight barrel to allow for a slight adjustment of the lamp relative to the reflector, thereby insuring centering of the lamp and the lamp filament to the reflector. In a second aspect, the switch housing has a seal which seals the forward end of the battery compartment. In the third aspect, assembly of the flashlight is improved because of the alignment of the internal component parts.

Accordingly, it is an object of the present invention to provide a flashlight having improved means for alignment between the lamp and reflector.

It is another object of the present invention to provide a flashlight with a switch assembly having improved sealing characteristics.

It is a further object of the present invention to provide a flashlight having improved assembly through aliment of internal components.

Other objects and features of the present invention will become apparent from the following detailed description taken in connection with the accompanying drawings which disclose one embodiment of the invention. It is to be understood, however, that the drawings are designed for the purpose of illustration only and are not intended as a definition of the limits of the invention.

BRIEF DESCRIPTION OF THE DRAWINGS

In the drawings, wherein similar reference characters denote similar elements throughout the several views.

DETAILED DESCRIPTION OF THE DRAWINGS

Figure 1:
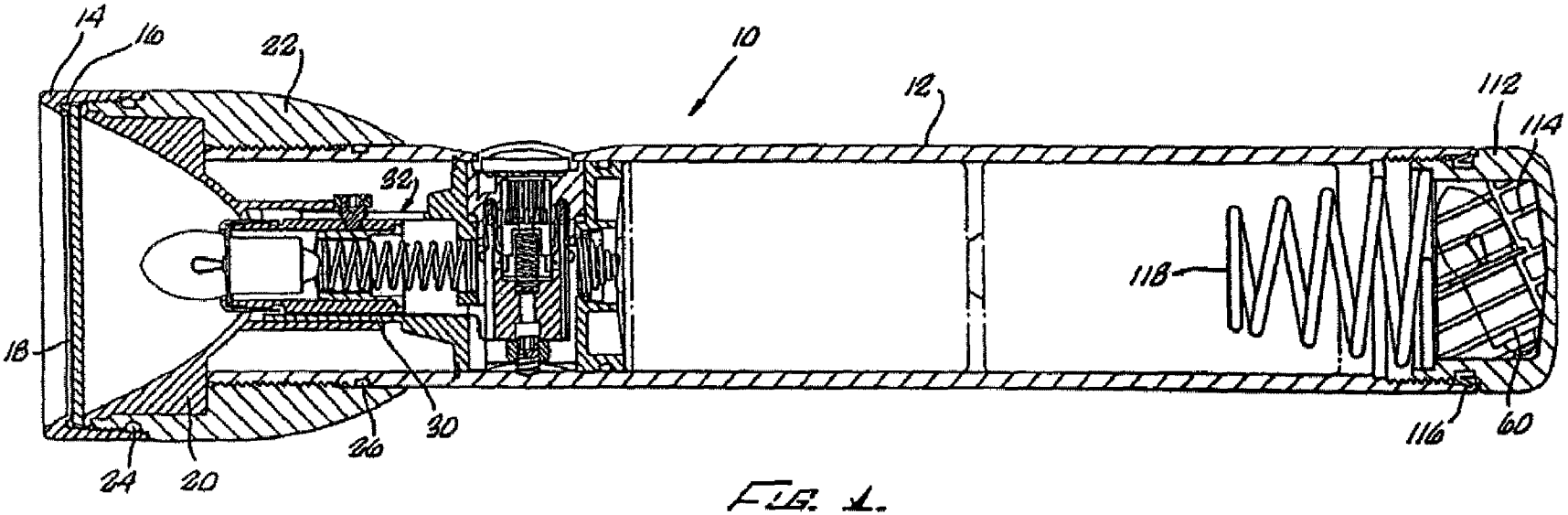
FIG. 1 is a section view of the present flashlight.
Figure 2:
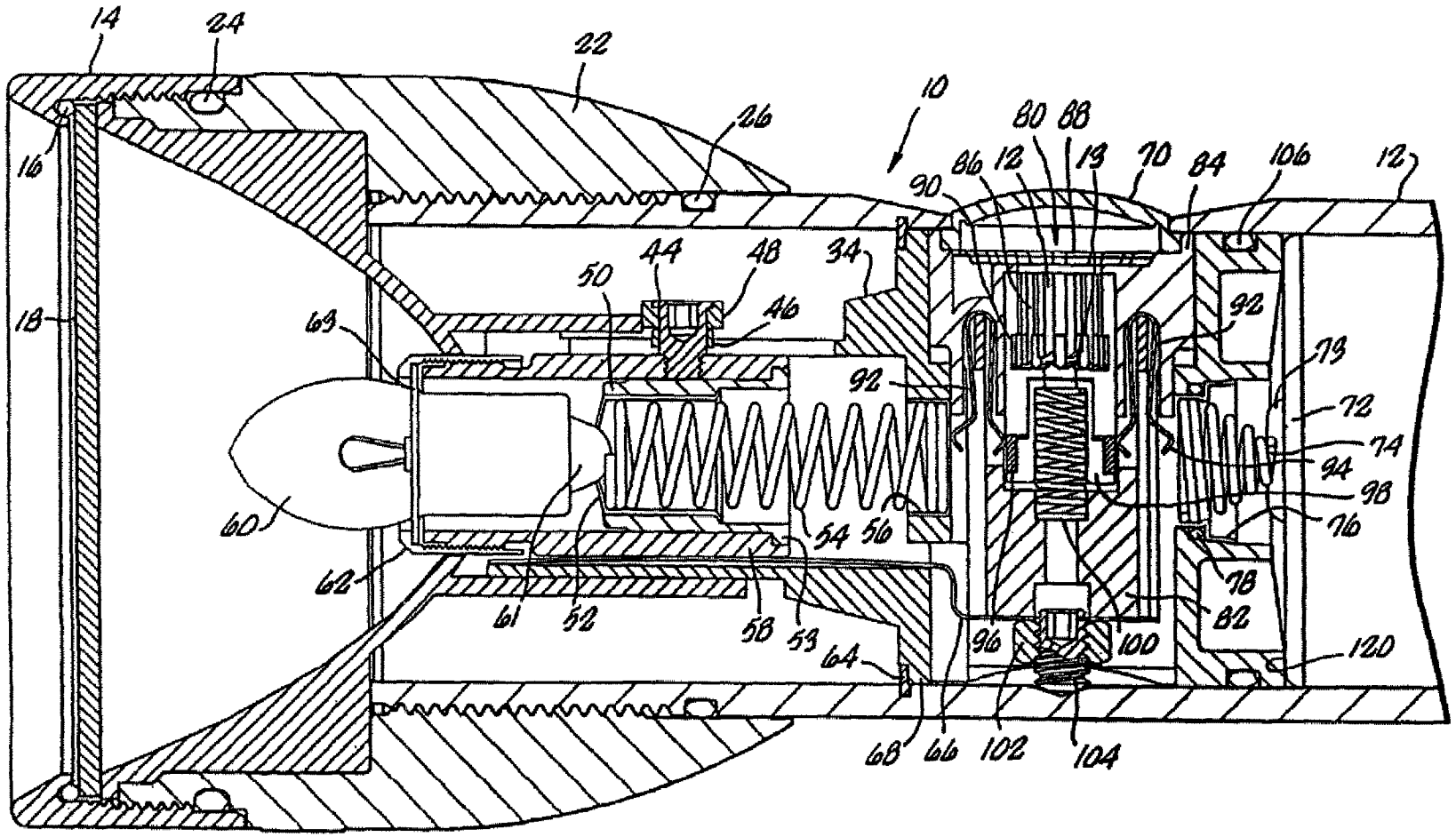
FIG. 2 is an enlarged section view of the switch and bulb holder assembly of the present flashlight.
Figure 3:
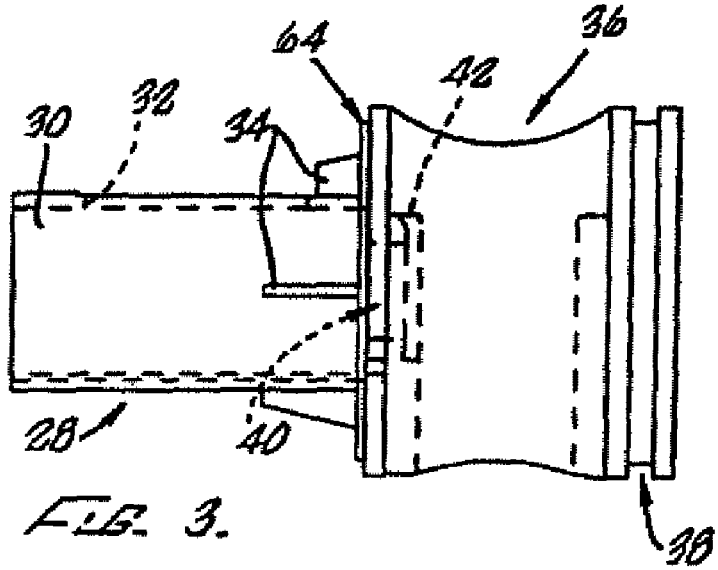
FIG. 3 is a side elevation view of the switch housing of the switch assembly shown in FIGS. 1 and 2.
Figure 4:
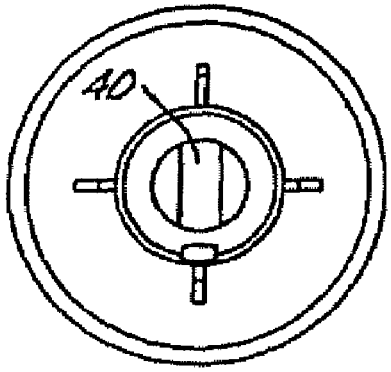
FIG. 4 is a front view thereof.
Figure 5:
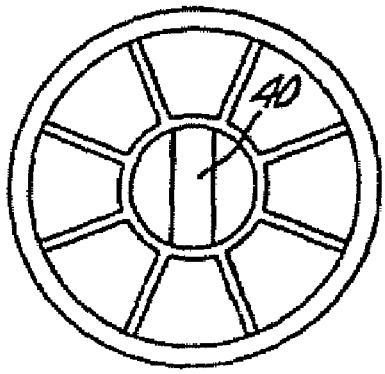
FIG. 5 is a rear view thereof.
Figure 6:
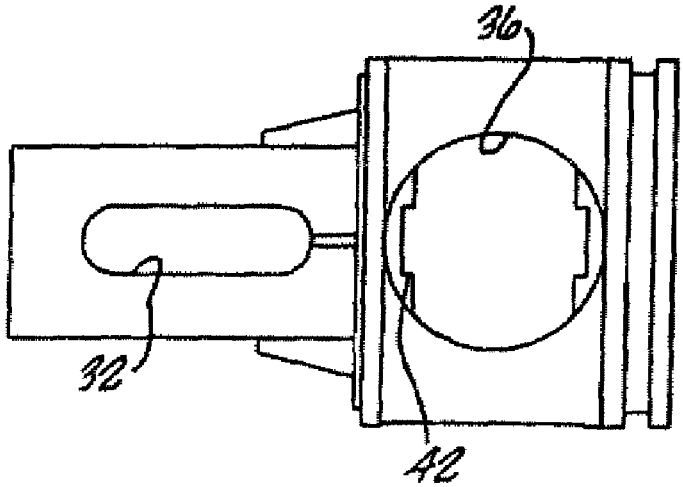
FIG. 6 is a top view thereof.

Turning in detail to the drawings, as shown in FIGS. 1 and 2, the present flashlight 10 has a barrel 12 having an externally threaded forward or front end and an internally threaded back or rear end. A head 22 is threaded onto the front end of the barrel 12. A face cap 14 is threaded onto the head 22. A lens 18, which may be clear or colored, is held in place in between the face cap 14 and a reflector 20. A face cap o-ring 16 positioned in a recess in the face cap 14 provides a resilient contact between the face cap 14 and the lens 18.

A head o-ring 24 seals the face cap 14 against the head 22. A barrel o-ring 26 rotatably seals the head 22 against the outside of the barrel 12.

As shown in FIGS. 3-6, a switch housing 28 has a neck 30 and a top neck slot 32. Gussets 34 may be provided for strength purposes. A receptacle bore 36 extends vertically through the switch housing 28. The receptacle bore 36 is generally double-D shaped, except at the uppermost portion above a shoulder 42 where it is preferably round. An o-ring slot 38 is provided at the rear end of the switch housing 28. Contact slots or openings 40 extend through the front and back surfaces of the switch housing 28 on opposite sides of the receptacle bore 36.

Referring back to FIG. 2, a lamp holder 58 is slidably positioned within the neck 30 of the switch housing 28, and biased forward by a spring 54. A contact 56 is attached to the back end of the spring and a receptacle contact 52 is attached to the front end of the spring 54. The receptacle contact 52 has a protruding or pointed front end for making electrical contact with the base 61 of the lamp 60. An insulator 50 overlies the sides of the receptacle contact 52 and has a rear flange 53 which seats against the bulb holder 58.

A shoulder screw 44 extends through the neck slot 32 in the switch housing neck 30 and is threaded into the bulb holder 58. A bushing 46 is positioned around the shoulder screw 44 in the neck slot 32, while a follower 48 is similarly positioned around the head of the shoulder screw 44 above the neck slot 32.

A lamp retainer 62 threaded onto the forward end of the lamp holder 58 secures the lamp 60 by clamping the lamp flange 63, A ground contact 66 extends from the switch housing neck 30 into the receptacle bore 36 and is electrically connected with the inside surface of the barrel 12. The lamp retainer 62, lamp holder 58, ground contact 66, barrel 12, contacts 56 and 52, spring 54 and barrel 12 are all electrically conducting materials, preferably metals.

A retaining ring 64 is placed within a groove on the inside surface of the barrel 12. The front flange 68 of the switch housing 28 seats against the retaining ring to longitudinally position the switch housing 28 within the barrel 12.

Referring still to FIG. 2, a generally cylindrical switch assembly 80 is positioned in the receptacle opening 36 of the switch housing 28. The switch assembly 80 has a lower switch assembly housing 82 and an upper switch assembly housing 84. An indexer 86 and a driver 88 are supported in the upper switch assembly housing 84 and cooperate with indexer ridges 90 therein. A return spring 100 biases the indexer 86 upwardly. Clip contacts 92 on opposite sides of the switch assembly 80 have protruding legs 94. A center contact ring 96 supported on a contact holder 98 alternately makes and breaks contact between the opposing clip contacts 92 as the driver 88 and indexer 86 are depressed to switch the lamp on and off. Alternate up and down movement of the center contact ring 96 with actuation of the switch assembly 80 results in a scrubbing action between the center contact ring 96 and the clip contacts 92. This scrubbing action improves reliability by helping to prevent a build up of contaminants on the center contact ring 96 and clip contacts 92. In addition the center contact ring 96 turns incrementally each time the switch assembly 80 is actuated. This turning movement also improves reliability by avoiding excessive wear on any single area of the center contact ring 96. A switch seal 70 covers the switch assembly 80 and seals a round opening in the barrel 12 over the switch assembly 80.

At the bottom end of the switch assembly 80 is a set screw 104 and nut 102 which connect the ground contact 66 to the barrel 12 and also vertically position the switch assembly 80 within the receptacle opening 36.

With the switch assembly 80 installed within the receptacle 36, the front clip contact 92 touches contact 56 and the back clip contact 92 touches a battery contact 76 supporting a battery connector or spring 74. The battery contact 76 seals against the back face of the switch housing 28 by an o-ring 78, Referring to FIG. 1, in the embodiment shown, two "D" size batteries or dry cells are contained within the battery compartment of the barrel 12, with the positive terminal of the front battery contacting the battery spring 74.

As best shown in FIG. 2, the outer circumference of the forward end (positive terminal end) of the battery 72 buts against the back surface rim 120 of the switch housing 28. This sets the spacing between the positive terminal 73 of the battery 72 and the switch housing 28. The battery spring 74 is selected and positioned within the switch housing 28 so that it contacts the positive terminal 73 of the battery 72 with sufficient, but not excessive force to avoid leakage caused by caving in the positive terminal.

A tail cap 12 threaded into the back end of the barrel 12 contains a lamp protector 114 cushioning a spare bulb or lamp 60. The lamp protector 114 is resilient. When removed from the tail cap 112, the lamp protector 114 may be spread apart to receive or release a spare lamp 60. When installed in the tail cap 112, the lamp protector 114 is held closed to cushion the lamp on all sides, e.g., on the glass, flange and/or base 61 of the lamp 60.

A tail cap spring 118 urges the batteries together and maintains them in contact with each other and the battery spring 74. A one-way seal 116 in the tail cap 112 allows any build up of gases in the battery compartment to vent to the outside without allowing moisture, contaminants, etc. to enter the battery compartment.

With the flashlight design as shown and described above, the switch housing 28 partially floats within the barrel 12 to allow for a slight adjustment between the switch housing supporting the lamp and the reflector 20, to facilitate centering alignment of the lamp and reflector. As shown in FIG. 2, the switch housing 28 is positioned generally concentrically within the barrel 12, i.e., the centerlines or longitudinal axes of the switch housing 28 and the barrel 12 coincide. The reflector 20 is also generally concentric with the barrel 12 and switch housing 28. Accordingly, since the lamp 60 is held by the lamp holder 60 on the centerline of the switch housing 28, it is also generally centered within the reflector 20 through the alignment of the reflector 20, barrel 12, and switch housing 28. Due to manufacturing tolerances, the diameter of the switch housing 28 is necessarily nominally smaller than the inside diameter of the barrel 12. This would ordinarily allow the switch housing 28 to freely radially shift slightly within the barrel 12, thereby causing a misalignment of the lamp and reflector. However, the o-ring 106, together with the retainer ring 64 allow the switch housing 28 to be slightly adjusted relative to the reflector to insure centering of the lamp with the reflector.

The batteries or dry cells may generate corrosive vapors or gases, which if not contained can corrode the switch assembly 80 electrical components, e.g., the clip contacts 92, center ring 96, etc. To prevent leakage of any gases from the battery compartment to the switch assembly 80 and forward thereof the housing o-ring 106 (and o-ring 78) seal the battery compartment from the switch assembly 80 and the front end of the flashlight.

Assembly is improved as the switch assembly 80 is placed within the receptacle opening 36 of the switch housing 28 and is positioned therein by the receptacle shoulders 42, and the switch housing 28 is positioned within the barrel by the retaining ring 64 and o-ring 106.

Thus, while one embodiment of the present invention has been shown and described, it will be obvious that many changes and modifications may be made thereunto without departing from the spirit and scope of the invention.

I claim:

1. A flashlight comprising:

a flashlight barrel;

a reflector located adjacent one end of the barrel;

a switch housing adjustably mounted within the barrel relative to the reflector and having a rear o-ring slot;

a switch assembly located within the switch housing;

a retainer adjacent a front side of the switch housing; and an o-ring positioned at least partially within the o-ring slot for sealing against the circumference of the barrel.

2. The flashlight of claim 1, wherein the switch assembly further comprising indexer ridges.

3. The flashlight of claim 2, wherein the switch assembly further comprising an indexer and a driver, wherein the indexer and the driver cooperate with the indexer ridges.

4. A flashlight comprising:

a flashlight barrel;

a reflector located adjacent one end of the barrel;

a switch housing adjustably mounted within the barrel relative to the reflector and having a rear o-ring slot;

a lamp holder operatively connected to the switch housing;

a lamp carried by the lamp holder;

a retainer adjacent a front side of the switch housing; and an o-ring positioned at least partially within the o-ring slot for sealing against the circumference of the barrel.

5. The flashlight of claim 4, wherein the lamp is moveable relative to the reflector for centering the lamp with respect to the reflector.

6. The flashlight of claim 4 further comprising a spring for biasing the lamp holder away from the switch housing.

7. The flashlight of claim 4 wherein the lamp holder through a central opening in the reflector.

8. The flashlight of claim 4 further comprising a neck attached to the switch housing.

9. The flashlight of claim 8 further comprising a slot in the switch housing neck and a set screw slider extending through the slot and engaging the lamp holder.

10. A flashlight comprising:

a flashlight barrel;

a reflector located adjacent one end of the barrel;

a switch housing adjustably mounted within the barrel relative to the reflector and having a rear o-ring slot;

a retainer adjacent a front side of the switch housing;

an o-ring positioned at least partially within the o-ring slot for sealing against the barrel;

a back surface rim on the switch housing; and a recess formed in an anterior portion of the switch housing centrically to the back surface rim.

11. The flashlight of claim 10 further comprising a battery spring having a base end and a contact end, wherein the battery spring is disposed in the recess formed in the anterior portion of the switch housing such that the base end is recessed from the back surface rim and the contact end is positioned for making contact with a terminal of a battery positioned within the barrel.

12. The flashlight of claim 10 further comprising a neck attached to the switch housing.

13. The flashlight of claim 12 further comprising a reflector sleeve extending from the reflector over the switch housing neck.

14. The flashlight of claim 12 further comprising a slot in the switch housing neck.

* * * * *